United States Patent [19]

Street

[11] Patent Number: 5,060,351

[45] Date of Patent: Oct. 29, 1991

[54] PROCESS AND APPARATUS FOR BLOWING CONTINUOUS FILAMENT TOW

[75] Inventor: Robert L. Street, Rock Hill, S.C.

[73] Assignee: WM. T. Burnett & Co., Inc., Baltimore, Md.

[21] Appl. No.: 532,746

[22] Filed: Jun. 4, 1990

[51] Int. Cl.[5] ..... D01D 11/02

[52] U.S. Cl. ..... 28/283; 19/66 T

[58] Field of Search ..... 19/66 T; 28/283

[56] References Cited

U.S. PATENT DOCUMENTS

| | | | |
|---|---|---|---|
| 3,156,016 | 11/1964 | Dunlap et al. | 19/66 T |
| 3,262,181 | 7/1966 | Hawkins et al. | 28/283 |
| 3,413,698 | 12/1968 | Fritz et al. | 28/283 X |
| 3,423,795 | 1/1969 | Watson | 19/66 T |
| 3,583,048 | 6/1971 | Gutmann, Jr. | 19/66 T X |
| 3,802,980 | 4/1974 | Harmon | 19/66 T X |
| 3,852,007 | 12/1974 | Levers et al. | 19/66 T X |
| 4,468,845 | 9/1984 | Harris | 28/283 |
| 4,522,616 | 6/1985 | Hyde et al. | 28/283 X |
| 4,525,385 | 6/1985 | Pryor | 19/66 T X |
| 4,637,104 | 1/1987 | Mente | 28/283 |

*Primary Examiner*—Werner H. Schroeder
*Assistant Examiner*—John J. Calvert
*Attorney, Agent, or Firm*—Breiner & Breiner

[57] ABSTRACT

Continuous filament tow is partially deregistered, preferably by passing over threaded rolls; and, after being partially deregistered, fully bloomed in an air-blooming mechanism. The air-blooming mechanism draws the partially deregistered tow into a turbulent air flow, maximizing bloom; and then carries the tow after blooming directly into a casing for formation of pillows, cushions, or the like articles. The process is simple and economical.

11 Claims, 2 Drawing Sheets

POINT X
MICRO-PROCESSOR
AIR
3:1 GEAR BOX
1:1 GEAR BOX
BRAKE
CLUTCH
M

PROCESS AND APPARATUS FOR BLOWING CONTINUOUS FILAMENT TOW

FIELD OF INVENTION

This invention relates to an apparatus for and to a process of making blown tow. More particularly, the invention is directed to a process of and an apparatus for the opening of a crimped continuous filament tow, and the blowing of the opened tow directly into a casing for an article such as a sleeping pillow, cushion, sleeping bag, or the like. The blown article made with the simplified process and apparatus, surprisingly, has the desirable characteristics of elaborately processed continuous filament tow.

BACKGROUND OF INVENTION

The use of webs or batts of continuous filament tow in the manufacture of cushions, sleeping pillows, sleeping bags, and the like is known. The art recognizes that the use of continuous filament tow provides products having superior characteristics, such as softness, resistance to sagging and compacting, and endurance, in comparison to the use of chopped tow or cotton battings. However, the art also recognizes that in making articles utilizing continuous filament tow it is essential to carefully process the tow so as to completely open or deregister the tow, and to then form the tow into batts or the like in order to get the desirable characteristics. This processing heretofore has utilized relatively complex equipment, requiring substantial plant space for installation.

Thus, Dunlap et al, U.S. Pat. No. 3,156,016, discloses an apparatus and process for opening continuous filament tow. According to the patent, a plurality of threaded rolls are aligned in a series. The continuous filament tow is caused to pass through the rolls to deregister the filaments. The filaments are then utilized in the formation of cigarette filters where the tow is maintained under control in a relatively compact longitudinal configuration. The tow made in this manner is not applicable to the fabrication of pillows, cushions, or the like. However, Watson in U.S. Pat. Nos. 3,423,795; 3,546,722, and 3,730,824 discloses the deregistering of continuous filament tow using a series of threaded rollers similar to those shown in Dunlap et al, and the subsequent spreading of the deregistered filaments in a plurality of stages, preferably using air. In all instances the deregistered filaments are controlled in the longitudinal direction by nip rolls or the like, again similar to Dunlap et al; precluding complete blooming of the filaments. The spread webs are subsequently collected in a stuffer box or crosslapped, as in the crosslapper of U.S. Pat. No. 3,660,867, where they are crumpled, bunched, and the like into a thick batting; the soft, bulky characteristics of the webs being retained.

It is apparent from the prior art that the processing of the continuous filament tow heretofore has required time-consuming steps in order to deregister, spread, and fluff the material so that it could be used as is conventional in the formation of pillows, cushions, and the like.

The art also recognizes, for example in patents such as Caines et al, U.S. Pat. No. 3,099,594, that the filaments of continuous filament tow can be separated or bloomed after passing over a series of deregistering threaded rolls using air, including a venturi. During the deregistration and air blooming, the filaments are again continuously under control. These controlled fibers are then processed into tobacco smoke filters for cigarettes and the like. As is apparent, the filaments used in filters have controlled bulk which is necessary to provide a filtering medium. The use of the venturi air is not intended to, and does not, provide total bulking and fluffing of the continuous filaments. As apparent from the prior art, it was not apparent or recognized that air alone would provide for the bulking of the tow to the extent necessary to permit use of the tow directly in an article such as sleeping pillows, cushions, sleeping bags, or the like.

SUMMARY OF INVENTION

According to the present invention, continuous filament tow is drawn directly from a carton containing the tow over a plurality of deregistering rolls, which can be threaded rolls and, after partial deregistration, fully bloomed in an air-blooming mechanism. The air-blooming mechanism draws the partially deregistered tow band away from the deregistering rolls and introduces the partially deregistered tow into a turbulent air flow. This turbulent air flow enhances the control of the process, but does not restrict the blooming process. Rather, the turbulent air flow enhances and maximizes bloom.

Surprisingly, the air-blooming mechanism not only opens and bulks the tow, but will carry the tow after blooming directly into a casing for formation of pillows or the like. It is not necessary to control or regain control of the tow before it is put into its application. The process is extremely simple and avoids the time-consuming and expensive operation of spreading the tow after deregistration and subsequent bunching or crosslapping, or other methods of regaining control of the tow for use in batts or the like. The apparatus, in addition to being greatly simplified, requires only very small plant space for installation and operation in comparison to prior art devices which necessarily utilized spreaders, bunchers, and/or crosslappers for the tow. Since it is not necessary to control or regain control of the tow, the process is greatly simplified, eliminating major handling problems. The desirable characteristics of the continuous filament tow obtained with the prior elaborate processes, surprisingly, are retained.

The following terms, as used herein, have the meanings continuous filament tow: a tow made of synthetic filaments by extrusion or drawing of a synthetic polymer, such as polyethylene terephthalate, and containing crimp;

tow band: a band of continuous filament tow having a width of from about two to six inches and containing from about 200,000 to about 1,000,000 filaments in essentially a longitudinally-extending, crimped relationship;

deregistering (of tow): complete separation of the filaments of a tow band while retaining crimp and elasticity;

partial deregistering (of tow): limited separation of the filaments of the tow band;

blooming (of tow): essentially complete deregistering of tow;

maximum bloom (of tow): complete blooming of tow to the extent possible;

controlled deregistering (of tow): maintaining control of filaments of the tow band in a linear plane while undergoing at least partial deregistration;

deregistering or blooming without control: deregistering or blooming of a tow band to obtain filaments in a multiplicity of planes without having or regaining control of the deregistered or bloomed filaments of the tow.

THE DRAWING AND PRESENTLY PREFERRED EMBODIMENT

A preferred embodiment of the invention will be described in reference to the drawing, wherein FIG. 1 is a schematic side view of a complete blowing line according to the present invention;

Figures 1, 2:
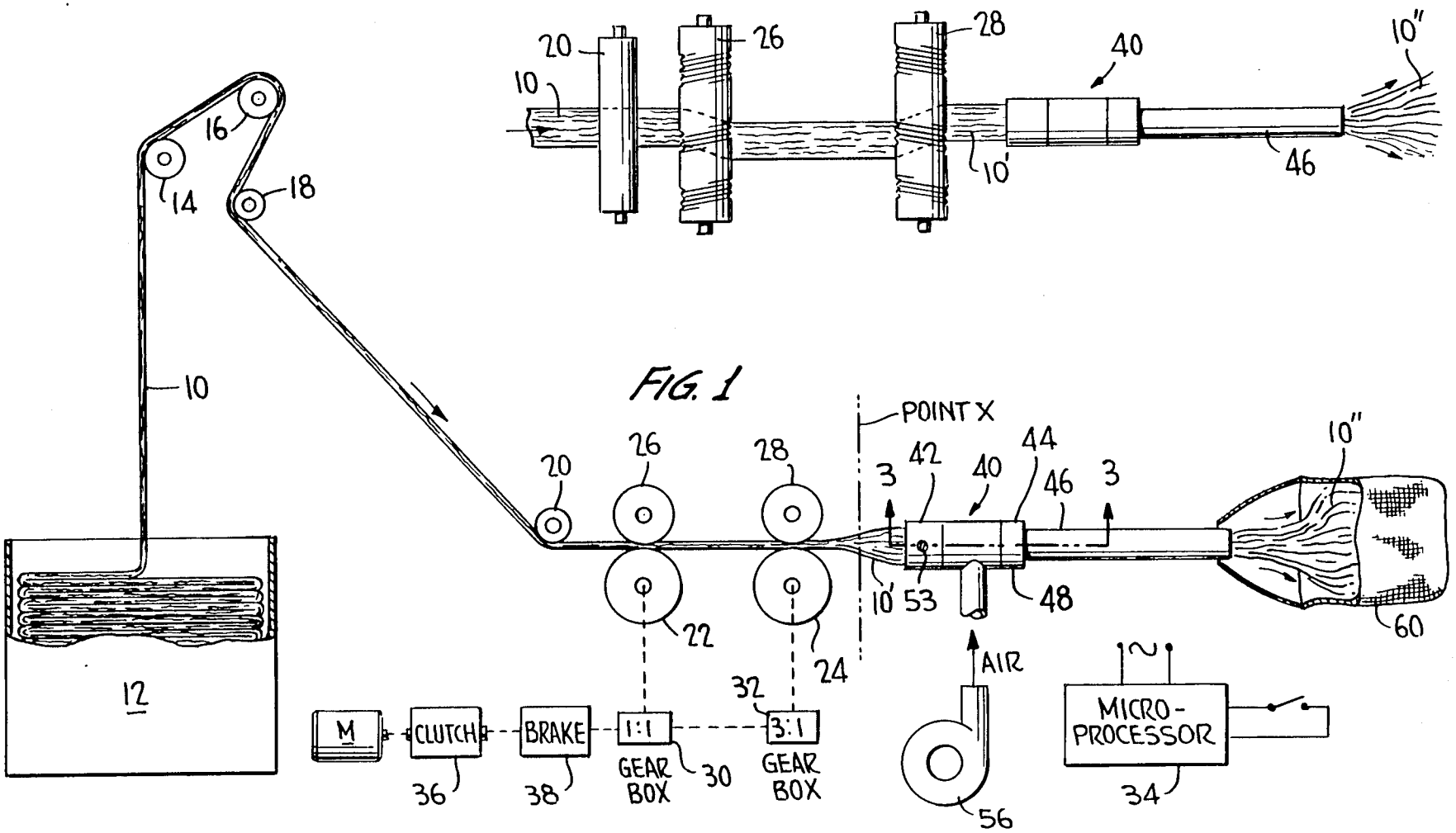
FIG. 2 is a schematic plan view of a section of the line of FIG. 1 showing primarily the threaded rolls and air-blooming mechanism.

As illustrated in FIG. 1, continuous filament tow 10, which can be a polyester such as polyethylene terephthalate, is drawn from a carton of tow 12 over a plurality of guide rolls 14, 16, 18 and 20 by driven nip rolls 22/26. Nip rolls 24/28 downstream of rolls 22/26 are deregistering rolls. As shown in FIGS. 1 and 2, driven roll 22 is constructed and arranged with a right-hand threaded roll 26, and driven roll 24 is constructed and arranged with a lefthand threaded roll 28. Driven nip rolls 22/24 are each driven by an electric motor M through separate gear boxes 30 and 32 which permit the rolls to be driven at different speeds. The speeds of the rolls are controlled by a microprocessor 34 which commands clutch 36 and brake 38. Alternatively, the gears can be replaced with a ratio drive such as belts and pulleys, or chains and sprockets.

Figure 3:
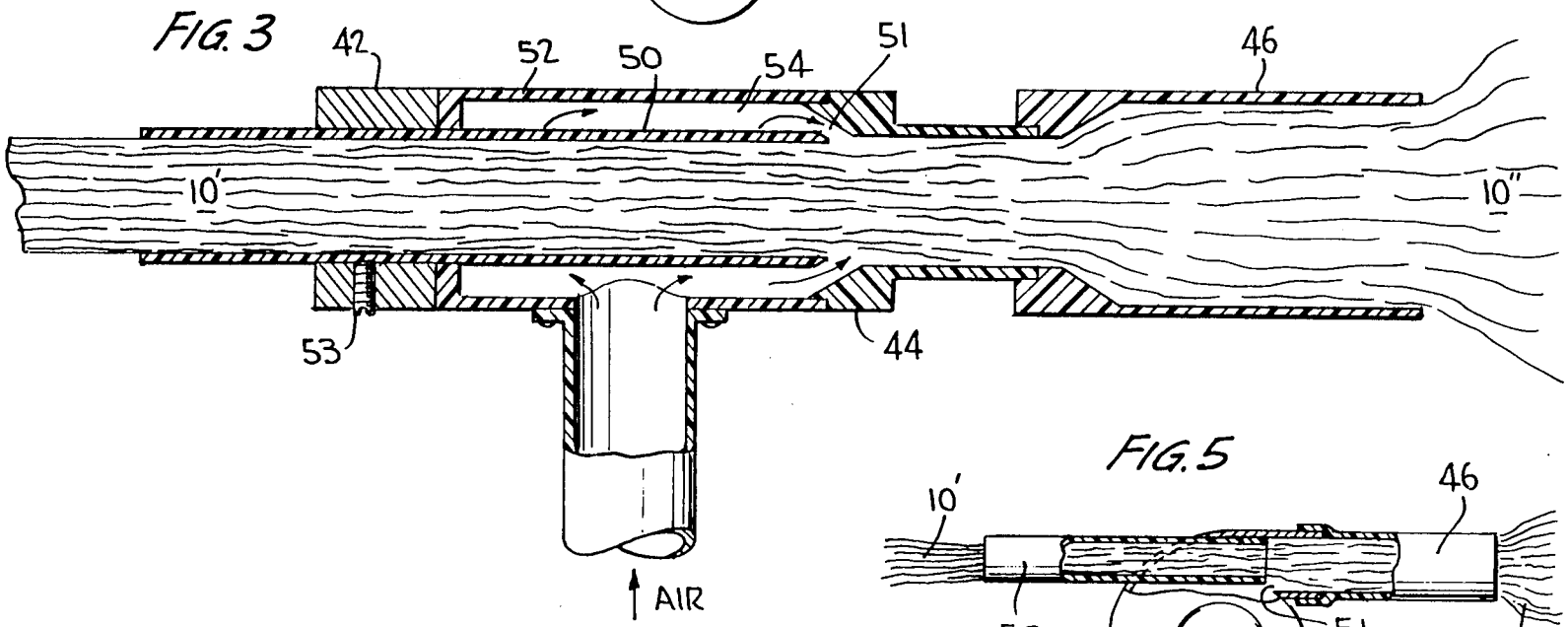
FIG. 3 is a sectional view of the air-blooming mechanism taken along line 3—3 of FIG. 1.

An air-blooming mechanism 40 is positioned downstream of threaded roll 28. The air-blooming mechanism, as best shown in FIGS. 1 and 3, comprises an inlet end 42, which receives partially deregistered tow 10' drawn from threaded roll 28; outlet end 44 connected to conduit 46, and a central body 48. Central body 48 comprises an adjustable inter tube 50 and an outer housing 52 forming an air passage 54 between inter tube 50 and housing 52, and creates an air gap 51 as shown in FIG. 3. Air gap 51 is adjustable by movement of inter tube 50 within housing 52 by releasing and setting set screws 53. Air from a blower 56 is fed into air space 54 created between inter tube 50 and housing 52. As shown in FIG. 3, a venturi effect is created at air gap 51. This venturi effect not only draws the tow 10' away from deregistering roll 28, but enhances the opening and fluffing of the tow and carries the tow through conduit 46 for delivery directly into a casing 60, such as a pillow casing, in its fully bloomed state 10''. As apparent, there is no control of the tow once fully bloomed by the air-blooming mechanism.

In the preferred embodiment of the apparatus of the present invention, rider rolls 26 and 28 are threaded rolls. As shown in FIG. 2, roll 26 has a righthand thread and roll 28 has a lefthand thread. The righthand thread will cause the tow to move in a first direction and the lefthand thread will draw the tow back into an aligned position. Also in the preferred embodiment, the threaded rolls will be driven at different speeds. For example, threaded roll 26 driven by nip roll 22 will be driven at 300 rpms, and roll 28 driven by nip roll 24 will be driven at 900 rpms, for a three to one ratio. Rolls 22/26 pull the tow, whereas rolls 24/28, driven at a different drive speed, provide a ratio which will enhance the deregistration of the tow.

Figure 4:
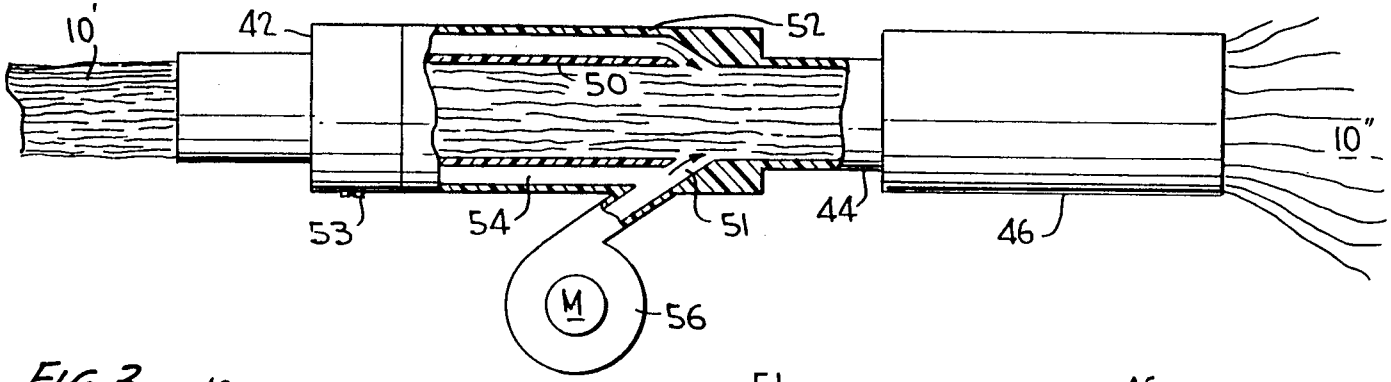
FIG. 4 is a sectional view, similar to the view of FIG. 3, of a modified air-blooming mechanism.
Figure 5:
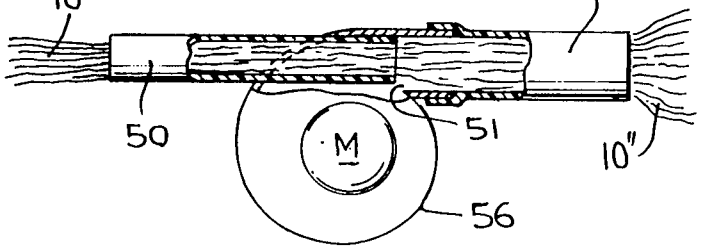
FIG. 5 is a sectional view, similar to the view of FIG. 3, of still another modified air-blooming mechanism.

In a typical embodiment, the air-blooming mechanism 40 comprises a polyvinylchloride central body 48 having bushings at each of ends 42 and 44. A polyvinylchloride inter tube 50 is positioned within housing 52. The inlet diameter is approximately 3-3/16" and the outlet diameter is $3\frac{7}{8}$" in diameter. In the preferred embodiment, the air fed to central body 48 is from a rotary ring compressor 56 used as a blowing system. Alternatively, as shown in FIG. 4, a modified air-blooming mechanism utilizes a volume fan 57 to create a venturi effect. Otherwise, the system of FIG. 4 is the same as shown in FIGS. 1 and 3. As another alternative, as illustrated in FIG. 5, a stock fan 56 is modified by attaching a tube 46 on the output end, cutting a hole in the fan housing, and inserting a tube 50. The adjustment of tube 50 within the fan housing will create an air gap 51 to provide a venturi effect, with the air flowing through gap 51. Again the system is otherwise as shown in FIGS. 1 and 3.

The entire operation of the device is controlled by microprocessor 34 which can be any conventional microprocessor utilized in the art. The microprocessor will control the speed of motor M in a time sequence through actuation of clutch 36. The operation can be stopped through brake 38. Tow 10 is drawn from carton 12 through guide rolls 14, 16, 18 and 20 by driven roll 22. This driven roll, with roll 26, pulls the tow from the carton. After passing through rolls 22, 26, rolls 24 and 28 partially deregister the filaments. The partially deregistered tow 10' is then drawn, starting at point X of FIG. 1, into the air-blooming mechanism 40 by suction created by the mechanism where the tow is acted upon by a turbulent air flow to open, further deregistering, and blooming the tow. The tow is carried into conduit 46, because of the venturi effect, and then blown without additional means through conduit 46 and into casing 60.

The operation of the device, as is apparent, is extremely simple. The apparatus utilized, being very simple, is relatively inexpensive and, additionally, occupies a relatively small space in a manufacturing plant. Also of great importance is the fact that the unit is clean in comparison to most operations where fibers are formed into a batting. These features cause the device to be desirable from the utility standpoint.

As will be apparent to one skilled in the art, various modifications can be made within the scope of the aforesaid description. Such modifications being within the ability of one skilled in the art form a part of the present invention and are embraced by the appended claims.

It is claimed:

1. A machine system for blooming continuous filament tow comprising means for partially deregistering continuous filament tow; means for creating a turbulent air flow channeled to draw said partially deregistered tow from said partial deregistering means and blooming said tow to maximize blooming for providing bulk to said tow; and means for collecting said bloomed tow at maximum bloom without restrainment on said tow.

2. The system of claim 1 wherein said means for partial deregistering comprises a plurality of threaded rolls.

3. The system of claim 2 wherein said means for creating a turbulent air flow comprises a housing having a first and second end, a movable tube within said housing, said housing and said tube being constructed and arranged to create an air passage between said housing and tubing, and an air gap at one end of said tubing which creates a venturi effect with air passage.

4. The system of claim 3 wherein said means for collecting said tow at maximum bloom is a casing.

5. The system of claim 4 wherein said casing is a pillow case.

6. The system of claim 4 wherein said casing is a cushion.

7. The system of claim 4 wherein said casing is a sleeping bag.

8. A system for developing continuous filament tow comprising means for drawing a tow band from a tow supply, means for partially deregistering filaments in said tow band, air means for drawing said partially deregistered filaments in said tow band from said partial deregistering means and imparting maximum blooming to said partially deregistered filaments to provide bulk, and means for collecting said bloomed tow at said maximized blooming without restrainment on said tow.

9. A method for blooming continuous filament tow comprising partially deregistering continuous filament tow, subjecting said partially deregistered tow to a turbulent air flow to maximize blooming of said tow and providing bulk to said tow, and collecting said tow in an unrestrained state at maximum bloom.

10. A method for blooming continuous filament tow comprising partially deregistering continuous filament tow, subjecting said partially deregistered tow to a turbulent air flow to maximize blooming of said tow and provide bulk to said tow, said blooming of said tow in said turbulent air flow being without restrainments on said tow, and collecting said tow in the fully bloomed state without restrainment on said tow.

11. A method for blooming continuous filament tow comprising drawing a tow band from a tow supply, partially deregistering the filaments in said tow band, subjecting said partially deregistered filaments to a turbulent air flow thereby imparting maximum blooming to said partially deregistered tow to provide bulking without restrainment on said tow, and collecting said bloomed, unrestrained tow at said maximized bloom.

* * * * *

US005060351A

REEXAMINATION CERTIFICATE (2313th)

United States Patent [19]

Street

[11] B1 5,060,351

[45] Certificate Issued Jun. 7, 1994

[54] PROCESS AND APPARATUS FOR BLOWING CONTINUOUS FILAMENT TOW

[75] Inventor: Robert L. Street, Rock Hill, S.C.

[73] Assignee: Wm. T. Burnett & Co., Inc., Baltimore, Md.

Reexamination Request:
No. 90/003,097, Jun. 10, 1993

Reexamination Certificate for:

| | |
|---|---|
| Patent No.: | **5,060,351** |
| Issued: | **Oct. 29, 1991** |
| Appl. No.: | **532,746** |
| Filed: | **Jun. 4, 1990** |

[51] Int. Cl.[5] ..... D01D 11/02

[52] U.S. Cl. ..... 28/283; 19/66 T; 28/282; 226/97

[58] Field of Search ..... 28/282, 283, 284; 226/97; 19/0.46, 0.48

[56] References Cited

U.S. PATENT DOCUMENTS

| | | | |
|---|---|---|---|
| 3,032,829 | 5/1962 | Mahoney et al. | 28/282 |
| 3,156,016 | 11/1964 | Dunlap et al. | 19/66 T |
| 3,262,181 | 7/1966 | Hawkins et al. | 28/283 |
| 3,413,698 | 12/1968 | Fritz et al. | 28/283 X |
| 3,423,795 | 1/1969 | Watson | 19/66 T |
| 3,583,048 | 6/1971 | Gutmann, Jr. | 19/66 T X |
| 3,739,566 | 6/1973 | Smith | 28/282 X |
| 3,802,980 | 4/1974 | Harmon | 19/66 T X |
| 3,819,469 | 6/1974 | Balch et al. | 28/282 X |
| 3,840,941 | 10/1974 | Neveu | 28/282 X |
| 3,852,007 | 12/1974 | Levers et al. | 19/66 T X |
| 3,874,030 | 4/1975 | Knight | 28/282 |
| 4,179,776 | 12/1979 | Wortman | 28/282 X |
| 4,215,805 | 8/1980 | Nielsen | 226/97 |
| 4,468,845 | 9/1984 | Harris | 28/283 |
| 4,522,616 | 6/1985 | Hyde et al. | 28/283 X |
| 4,525,385 | 6/1985 | Pryor | 19/66 T X |
| 4,637,104 | 1/1987 | Mente | 28/283 |

*Primary Examiner*—Clifford D. Crowder

[57] ABSTRACT

Continuous filament tow is partially deregistered, preferably by passing over threaded rolls; and, after being partially deregistered, fully bloomed in an air-blooming mechanism. The air-blooming mechanism draws the partially deregistered tow into a turbulent air flow, maximizing bloom; and then carries the tow after blooming directly into a casing for formation of pillows, cushions, or the like articles. The process is simple and economical.

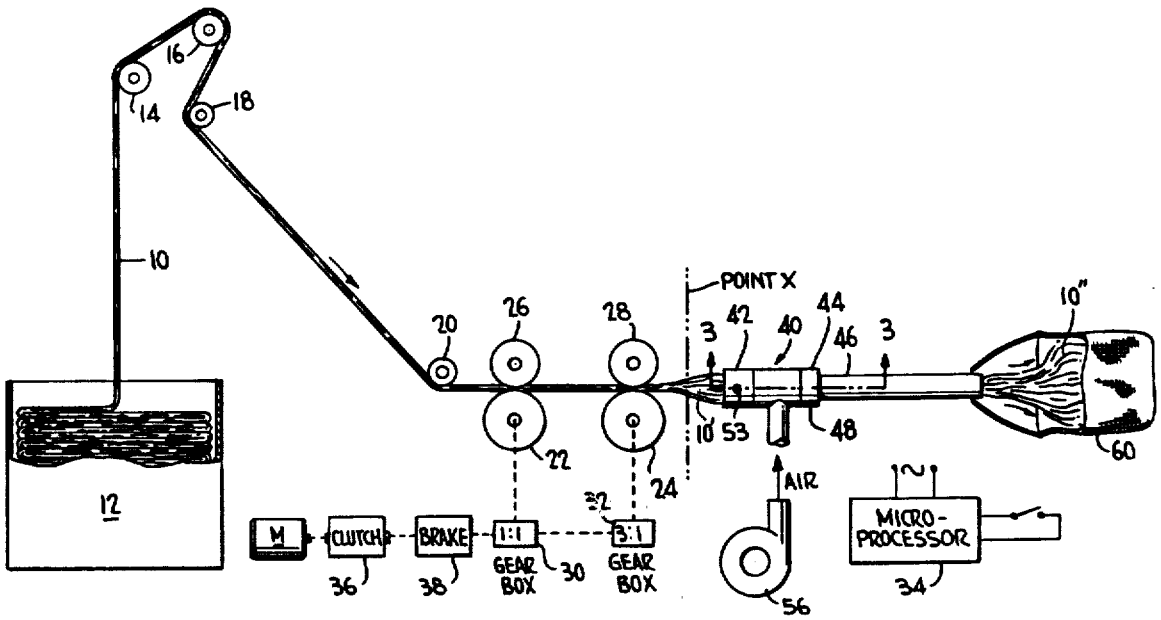

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS BEEN DETERMINED THAT:

The patentability of claims 1-11 are confirmed.

* * * * *